US005104055A

United States Patent [19]

Buxton

[11] Patent Number: 5,104,055

[45] Date of Patent: Apr. 14, 1992

[54] APPARATUS AND METHOD FOR MAKING CONVOLUTELY WOUND LOGS

[75] Inventor: Gerry Buxton, Green Bay, Wis.

[73] Assignee: Paper Converting Machine Company, Green Bay, Wis.

[21] Appl. No.: 650,759

[22] Filed: Feb. 5, 1991

[51] Int. Cl.[5] ..... B65H 19/28

[52] U.S. Cl. ..... 242/66; 242/56 R

[58] Field of Search ..... 242/66, 65, 56 R, 56 A, 242/67.1 R, 67.2, 74

[56] References Cited

U.S. PATENT DOCUMENTS

| | | | |
|---|---|---|---|
| 2,769,600 | 11/1956 | Kwitek et al. . | |
| 3,179,348 | 4/1965 | Nystrand et al. . | |
| 4,327,877 | 5/1982 | Perini | 242/66 |
| 4,723,724 | 2/1988 | Bradley | 242/56 R |
| 4,828,195 | 5/1989 | Hertel et al. | 242/66 |
| 5,031,850 | 7/1991 | Biagiotti | 242/66 |

*Primary Examiner*—John M. Jillions

*Attorney, Agent, or Firm*—Tilton, Fallon, Lungmus & Chestnut

[57] ABSTRACT

A surface winder for developing a convolutely wound log in which a core introduced into a winding nip is first rotated before engaging a web to effect cutoff and transfer.

9 Claims, 2 Drawing Sheets

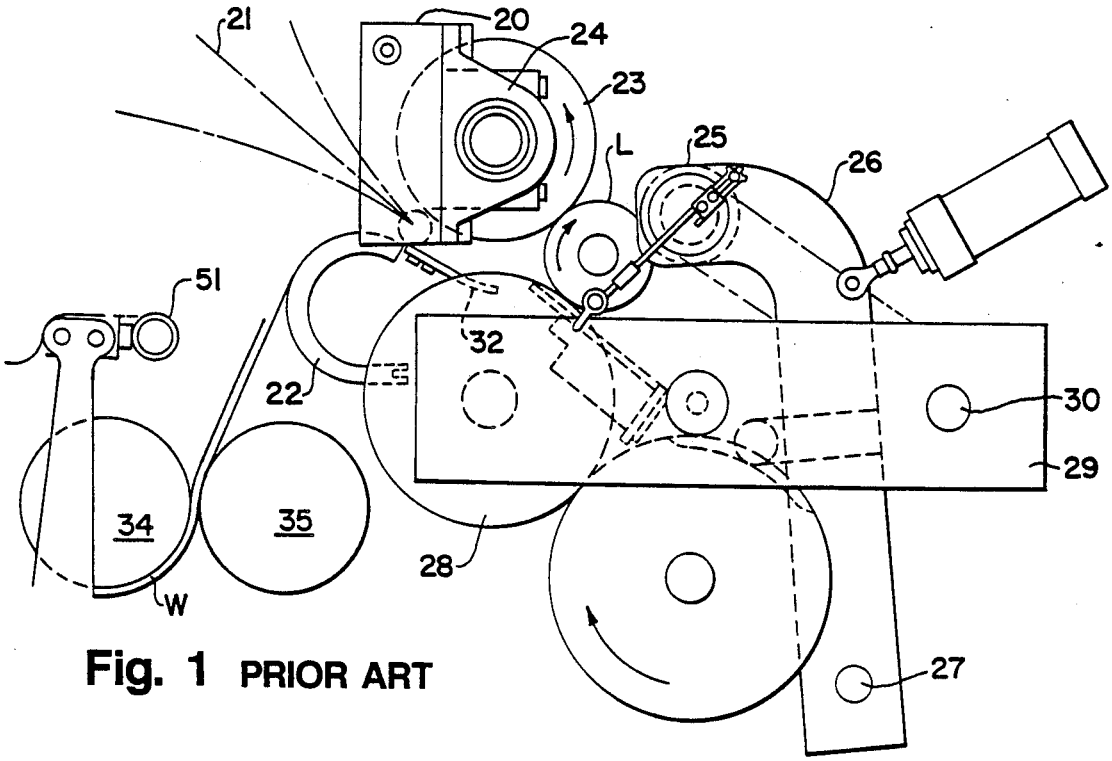
Fig. 1 PRIOR ART
Fig. 2
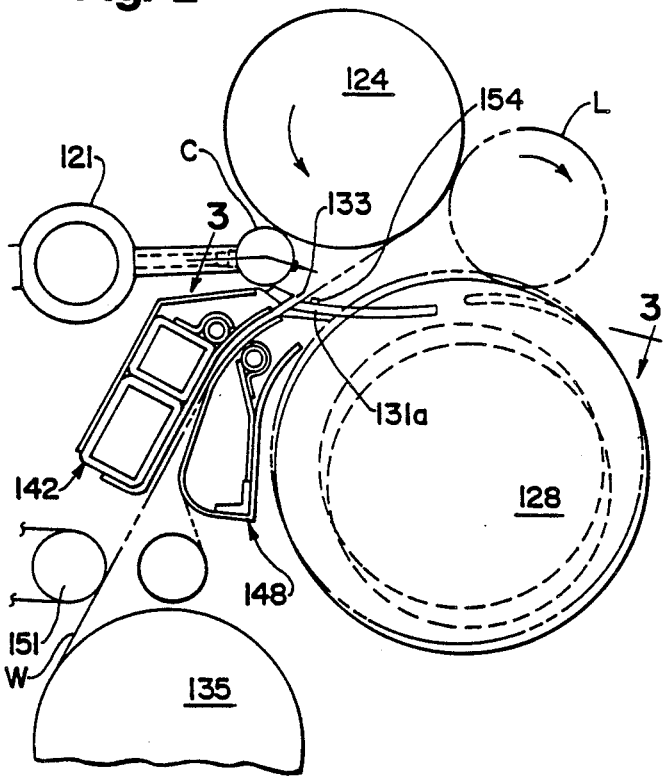
Fig. 3
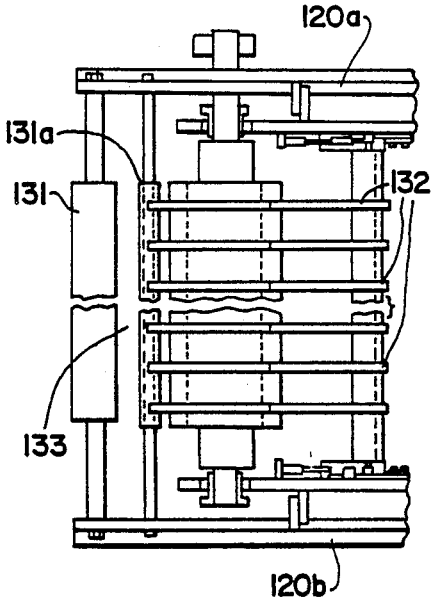

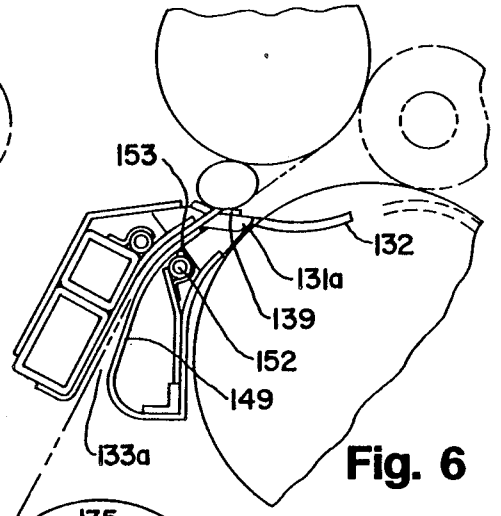
Fig. 6
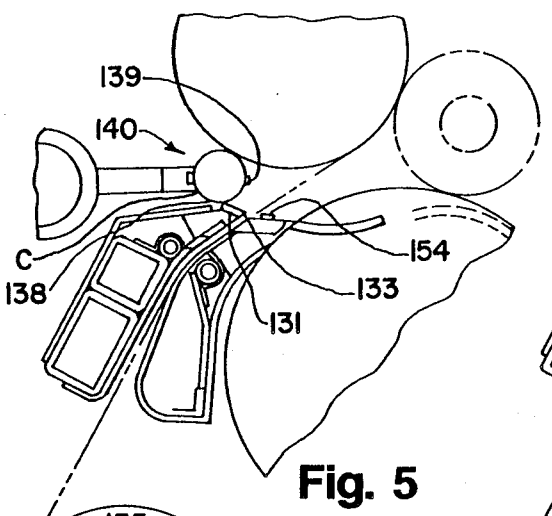
Fig. 5
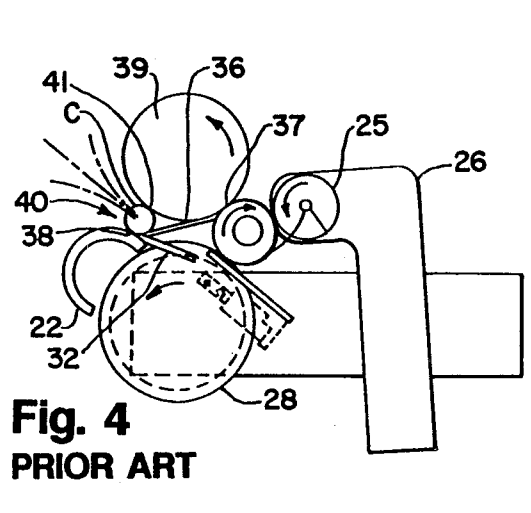
Fig. 4
PRIOR ART
Fig. 9
Fig. 8
Fig. 7

APPARATUS AND METHOD FOR MAKING CONVOLUTELY WOUND LOGS

BACKGROUND AND SUMMARY OF INVENTION

This invention relates to apparatus and method for making convolutely wound logs and, more particularly to logs such as toilet tissue and toweling.

Up to about 1950, stop-start winders (sometimes referred to as "rewinders") were used to convert jumbo-sized rolls of paper from the paper machine to retail-sized rolls. The critical feature in winding is cutoff and transfer. When the small roll or log is wound to its predetermined "count", it was necessary to sever the web transversely and transfer the web leading edge to a glue-equipped core. After about 1950, this was done automatically so that the winders could operate at continuous speed.

Two types of winders have been used. The most widely-employed for years has been the "center" wound type. These used a mandrel on which the core was ensleeved—with the mandrel being turned with a decreasing speed as the log increased in diameter. The cutoff and transfer problem was handled advantageously first by co-owned U.S. Pat. No. 2,769,600 and thereafter, when higher speeds were required, by co-owned U.S. Pat. No. 3,179,348.

More recently, surface winders have become popular because of being able to avoid the mechanisms used for the decreasing speed characteristic—thus being less complex and cheaper. These have employed a three-roll cradle, a stationary winding roll, a second winding roll which could be movable, and a movable rider roll.

The cutoff and transfer problem was addressed advantageously first by co-owned U.S. Pat. No. 4,723,724 and, more recently, by co-owned U.S. Pat. No. 4,828,195.

In the '195 patent, the web was severed, i.e., "cutoff" by being tensioned between a downstream point provided by the contact of the almost-finished log with the stationary winding roll and an upstream point where the core pinched the web against a breaker bar. Thereafter, the core had to rotate to bring a glue-stripe into engagement with the web. The rotation was necessary because the glue stripe on the core had to be between the winding roll and the web on the pinch plate. This resulted in excess material, i.e., slack, in the web leading edge and it also meant that the reversed leading edge was not under control.

According to the invention, the core is introduced into the nip between the stationary winding roll and the pinch bar without any contact with the web. The coaction of the stationary winding roll and the pinch bar causes the core to rotate to bring the glue stripe into confronting relation with the web when the core first contacts the web to provide the upstream pinch point. This results in severance and transfer substantially simultaneously so as to reduce both undesirable slack generation and an uncontrolled leading edge.

BRIEF DESCRIPTION OF THE DRAWING

The invention is described in conjunction with an illustrative embodiment in the accompanying drawing, in which—

FIG. 1 is a fragmentary side elevational view of a surface winder constructed according to prior art U.S. Pat. No. 4,828,195;

FIG. 2 is a view similar to FIG. 1 but showing the surface winder of the instant invention;

FIG. 3 is a fragmentary top plan view of a section of the winder such as would be seen along the sight-line 3—3 applied to FIG. 2;

FIG. 4 is a schematic side elevational view of the cradle rolls of the prior art '195 patent in "cutoff" position; and FIGS. 5–9 are views similar to FIG. 4 but showing the operation of the instant invention.

DETAILED DESCRIPTION

Inasmuch as this invention is an improvement on Hertel and Buxton U.S. Pat. No. 4,828,195, reference to that patent may be made for details of construction and operation not set down herein. It will be appreciated that the basic arrangements are the same and therefore FIG. 1 shows basic details of the '195 patent.

There, the symbol W designates a web arranged for advance through a first path within the frame 20 of the winder. Shown schematically in the upper left portion of FIG. 1 is a hypocycloidal core-inserting mechanism 21, the details of which can be seen in co-owned U.S. Pat. No. 4,723,724.

FIG. 1 illustrates the orientation of the web at the end of one winding cycle and the beginning of the next. The web passes over stationary turning bar 22 and into contact with a core C just prior to cutoff transfer. The web continues toward the stationary winding roll 23 which is mounted on the frame 20 at 24. The web W is finally seen to be in the process of being wound into a log L.

The log L is contacted by a rider roll 25 carried by a pair of pivotally mounted arms 26 which are pivotally mounted on the frame as at 27. The log L is also contacted by the lower, movable winding roll 2 which together with rolls 23 and 25 form a three-roll cradle. The lower winding roll 28 is carried by pivot arms 29 which pivot around axis 30. The function of the winding roll 28 in this invention is the same as that described in the '195 patent—this invention being concerned with what happens upstream of the winding roll 28, so the invention has broader application than just to the '195 construction.

The important difference between this invention and that of the '195 patent is the relocation of the path of web W. This can be appreciated from FIG. 2 to which reference is now made.

In FIG. 2, there is again the three-roll cradle consisting of stationary winding roll 124, the winding roll 128 and the rider roll 125. Contrary to the path of web W in FIG. 1 where it is fed over turning bar 22 into contact with the core C which is pinched between roll 23 and bar 22, the web path in FIG. 2 enters the three-roll cradle downstream of the point where the stationary winding roll 124 pinches the core C against the pinch bar 131—see also FIG. 3.

In FIG. 3, the frame includes a pair of side frames **120*a* and 120*b*. In addition to supporting all the rolls in the fashion described in the '195 patent, the frame supports the pinch bar 131 and the transfer bar 131*a*. In turn, the transfer bar 131*a* supports the stationary fingers 132 (compare FIG. 4 with FIGS. 5 and 6). In contrast to the '195 showing, the pinch bar 131 is spaced from the fingers 132 (similar to fingers 32** of the '195 construction) by a throat or gap 133 through which the web W passes in traveling from draw rolls one of which is seen at 135. These perform the same function as the draw rolls 34, 35 of FIG. 1 in feeding the web W from the parent roll (not shown) to the winder. As indicated previously, the core C according to the invention and differing from the '195 patent—begins to rotate prior to engagement with the web W. As can be appreciated from FIG. 2, the core C after insertion by the mechanism 121 contacts the stationary winding roll 124 at the top (as shown) and the pinch bar 131 at its bottom (also as shown). With the winding roll 124 rotating counterclockwise and with the pinch bar 131 being stationary, the core C rotates clockwise and moves to the right in FIG. 2—ultimately contacting the web W which is passing through the throat 133. The operation of the invention—and the difference from the prior art '195 patent can be appreciated from a consideration of FIGS. 5–9.

OPERATION

In the prior art showing of FIG. 4, the web W is about to be snapped along a line of perforation 36 located between the downstream pinch point 37 and the upstream pinch point 38. The downstream pinch point 37 is provided by the contact (a line or area of tangency) of the log L with the roll 23. The upstream pinch point is provided by the contact of the core C with the turning bar 22. The snapping occurs because the web is tensioned between the two points—being advanced at winder speed by the log L downstream but relatively retarded by the core C which is about to begin its rotation. This results in a substantial leading edge portion of the web—between the point 38 and perforation line 36 and which leading edge portion is uncontrolled.

The core C has been introduced into the nip generally designated 40 with its glue stripe 39 approximately midway between the upper and lower contact points 41 and 38, respectively. Introducing the core with the glue stripe near the upper contact point 41 could result in fouling the roll 23 while a lower stripe location could wipe the glue from the core by contact with the web W. So, until the core rotates about 90°, there is no attachment of the web to the core—but meanwhile the web has been snapped.

In contrast, the invention (as seen in FIGS. 5 and 9) provides no contact between the core and web until the core has moved to the position of FIG. 6 where the glue stripe 139 is at its nearest point to the web. It is at this time that severance occurs at 136 (see FIG. 7). Thus, there is substantially simultaneous "cutoff", viz., severance, and transfer. This results in a much shorter length of time during which the web is stopped, providing superior control because the web is now advanced by the core. For example, a 1.7 inch diameter core produces about 5 inches of slack with the '195 configuration but only about 1.75 inches of slack with the instant invention. This happens in the '195 configuration because the web is still advancing after core-web contact until the glue stripe on the core contacts the web. In the invention, the two contacts occur simultaneously—not being separated in time and space.

SUPPORTING STRUCTURE

The instant invention differs from the '195 patent prior art in the structures employed for supporting the pinch bar means 131 and the stationary finger means 132.

Referring to FIG. 2, the numeral 142 generally designates a tubular supporting member that extends between the side frames **120*a* and 120*b*. The member 142 carries a pair of projecting elements 143, 144 (see FIG. 9) which, in turn, carry the pinch bar 131. Also carried by the member 142 is a pipe 145 (still referring to FIG. 9) connected to an air source (not shown). The element 144 is equipped with an opening 146 which permits air flowing out of wall apertures 147 in the pipe 145 (see FIG. 8) to impinge against the web W and flow out of the throat 133**.

The fingers 132 are carried by a transfer bar **131*a* which in turn is mounted on the side frames 120*a* and 120*b*—see FIG. 3. Also supported from the transfer bar 131*a* and also connected to the side frames is an angle iron support generally designated 148. Extending between the transfer bar 131*a* and angle iron support 148 are another pair of projecting elements 149, 150 (see FIG. 7). The elements 144, 149 define a chute or passage 133*a* through which the web W travels from the draw roll 135 through the throat 133 to the three-roll cradle (124, 128, 125). Here, I again employ a compensator as at 151 (or 51 in FIG. 1) to take up slack upstream of the upstream pinch points 38, 138 (FIGS. 4 and 5**, respectively). However, the compensator is unable to respond as fast as the slack is being generated.

A second air jet means for the throat 133 is provided in the form of a second pipe 152 (see FIG. 6)—like that provided at 145. Again, the element 149 adjacent thereto is equipped with an opening 153 to permit air flow from apertures in the pipe 152 against the web W.

The fingers 132 function in this invention in the same way as the fingers 32 did in the prior art '195 patent—providing support for the core when it proceeds in the nip defined by the winding rolls 124, 128. Then, as the winding proceeds, the nip may be opened by moving the roll 128 away from the roll 124 to place the partially wound log L in the three-roll cradle position.

SUMMARY OF INVENTION

To improve the operation of the '195 patent surface winder by reducing the amount of slack upstream of the attachment point and to better control the web, I have relocated the path of travel of the web W. More particularly, I have moved the path of travel of the web further into the winder—in effect, extending the path of travel of the core. In the '195 patent prior art, the core path terminated when the core was introduced into the nip 40 between the stationary, winding roll 24 and the turning bar 22 where pinching of the web occurred at 38—see FIG. 4.

Now, the core path is lengthened before it merges into the web path—see FIGS. 6 and 7—where the glue stripe 139 is positioned to engage the web W at the time of severance, severing occurring at 136. Now, the web is being wound on the previous log until contact occurs between the glue stripe and the web.

In the illustrated embodiment, I provide presser means for the web/glue stripe engagement as at 154—see FIGS. 2 and 5. Although excellent results are obtained without the presser means 154, this could be a safeguard to insure transfer in the case of a distorted core.

In any event, the core path includes a segment wherein the core enters the nip 140 between the stationary winding roll 124 and pinch bar means 131—and upstream of the path of the web—see FIG. 5. This nip engagement results in rotating and advancing the core by rolling on the pinch bar means to the FIG. 6 position where, for the first time, the core engages the web W.

While in the foregoing specification a detailed description of an embodiment of the invention has been set down for the purpose of illustration, many variations in the details hereingiven may be made by those skilled in the art without departing from the spirit and scope of the invention.

I claim:

1. A surface winder for developing a web log comprising a frame, means operatively associated with said frame for advancing a web along a predetermined path in said frame, a first winding roll rotatably mounted in said frame on one side of said path, stationary finger means mounted on said frame on the other side of said path adjacent said first winding roll and spaced therefrom a distance sufficient to receive a core to be wound in said path, said first winding roll cooperating with said stationary finger means to rotate said core, a second winding roll rotatably mounted in said frame on the other side of said path and downstream in the direction of web advance from said stationary finger means and forming a nip with said first winding roll, means on said frame for moving a core along a second path, said second path merging with said first path, said first winding roll being on a first side of said second path, and pinch bar means on the second side of said second path also adjacent said first winding roll to receive a core and cause the same to rotate, said pinch bar means being spaced from said stationary finger means to provide a throat to enable said web to pass between said pinch bar means and said stationary finger means.

2. The structure of claim 1 in which two spaced apart support means are provided on said frame on opposite sides of said first path upstream of said throat, one of said support means being connected to said pinch bar means and the other to said stationary finger means, draw roll means rotatably mounted on said frame in said first path upstream to said two support means, said two support means defining a passage for said web in traveling from said draw roll means to said throat.

3. The structure of claim 2 in which said support means are equipped with air jet means for delivering air through said throat.

4. The structure of claim 1 in which said finger means is equipped with presser means for urging said web against each glue stripe-equipped core.

5. The structure of claim 4 in which said presser means is positioned approximately 90° of the core circumference from the downstream end of said pinch bar means.

6. The structure of claim 1 in which said stationary finger means includes a transfer bar supported on said frame and, in turn, supporting a plurality of stationary fingers.

7. The structure of claim 1 in which said second winding roll is movably mounted on said frame.

8. A surface winder for developing a log of convolutely wound web material comprising a frame, means on said frame for advancing a web along a first path, means on said frame for advancing cores sequentially along a second path with the second path merging with and terminating in said first path so as to contact a core with said web, a first winding roll rotatably mounted on said frame on one side of the point of path merger, a second winding roll rotatably mounted on said frame below the other side of said merger point and forming a nip with said first winding roll downstream in said first path, pinch plate means mounted on said frame upstream of said merger point and positioned between said first and second paths for coaction with said first winding roll in imparting rotation to a core prior to contact thereof with said web, finger means on said frame aligned with but spaced from said pinch plate means and positioned on the side of said first path opposite to the side on which said pinch plate is positioned, said finger means coacting with said first winding roll to wind said web on a core.

9. A method of winding a web on a core to develop a wound log comprising introducing cores sequentially into a nip between a rotating, stationary winding roll and a fixed pinch bar, each core having an axially extending glue stripe approximately midway between the lines of contact of said core with said stationary winding roll and said fixed pinch bar, rotating each said core to cause the same to roll on said pinch bar, first contacting said core with a continuously advancing web when said glue stripe is in approximate confronting relation with said web whereby web severance and transfer to said core occur substantially simultaneously, and thereafter continuing to rotate said core to wind the web thereon.

* * * * *